US008267392B2

(12) United States Patent
Morgott et al.

(10) Patent No.: US 8,267,392 B2
(45) Date of Patent: Sep. 18, 2012

(54) DOCUMENT PRINTER AND INSERTER

(75) Inventors: Anthony F. Morgott, Farmington Hills, MI (US); Mark J. Jordan, South Lyon, MI (US)

(73) Assignee: Andersen & Associates, Wixom, MI (US)

( * ) Notice: Subject to any disclaimer, the term of this patent is extended or adjusted under 35 U.S.C. 154(b) by 0 days.

(21) Appl. No.: 13/404,449

(22) Filed: Feb. 24, 2012

(65) Prior Publication Data

US 2012/0153562 A1 Jun. 21, 2012

Related U.S. Application Data

(62) Division of application No. 12/896,979, filed on Oct. 4, 2010, now Pat. No. 8,123,223.

(51) Int. Cl.
*B65H 33/04* (2006.01)

(52) U.S. Cl. ..... 270/58.01; 270/58.06; 270/58.19; 271/200; 271/292; 271/294

(58) Field of Classification Search ..... 270/58.01, 270/58.06, 58.19; 271/292, 294, 200
See application file for complete search history.

(56) References Cited

U.S. PATENT DOCUMENTS

| | | | | |
|---|---|---|---|---|
| 3,028,980 | A | 4/1962 | Lindqvist | |
| 4,318,484 | A | 3/1982 | Stiernspetz | |
| 4,517,650 | A | 5/1985 | Gomes et al. | |
| 4,525,788 | A | 6/1985 | Gottlieb et al. | |
| 4,547,856 | A | 10/1985 | Piotroski et al. | |
| 4,720,960 | A | 1/1988 | Green | |
| 5,027,279 | A | 6/1991 | Gottlieb et al. | |
| 5,419,457 | A | 5/1995 | Ross et al. | |
| 5,842,696 | A | 12/1998 | Haan et al. | |
| 6,095,513 | A | 8/2000 | Wright et al. | |
| 6,164,640 | A | 12/2000 | Stengl et al. | |
| 6,189,883 | B1 | 2/2001 | Wright et al. | |
| 6,244,584 | B1 | 6/2001 | Holbrook et al. | |
| 6,305,680 | B1 | 10/2001 | Allen et al. | |
| 6,364,305 | B1 | 4/2002 | Sussmeier et al. | |
| 6,367,793 | B1 | 4/2002 | O'Dea et al. | |
| 6,615,105 | B2 | 9/2003 | Masotta | |
| 6,621,591 | B2 | 9/2003 | Kramer et al. | |
| 7,631,866 | B2 | 12/2009 | Otomo et al. | |
| 7,930,869 | B2 * | 4/2011 | Rozenkranz | 53/473 |
| 7,954,810 | B2 | 6/2011 | Van Den Aker | |
| 2009/0121417 | A1 | 5/2009 | Nishimura et al. | |

* cited by examiner

*Primary Examiner* — David H Bollinger
(74) *Attorney, Agent, or Firm* — Harness, Dickey & Pierce, P.L.C.

(57) ABSTRACT

An inserter device for a document printer and inserter system includes a first container sensor. A belt mechanism includes a flexible delivery belt receiving a printed document from a document printer. A motor rotates the delivery belt in response to an actuation signal from the first container sensor indicating the presence of a container at a document loading position proximate the delivery belt. A support shaft is rotatably connected to a support frame. The belt mechanism is fixed to the support shaft. The support shaft is rotated to achieve a desired belt drive angle and fixed to the support frame to maintain the belt drive angle. A rigid document diverter proximate the delivery belt deflects a document discharged from the delivery belt at the belt drive angle into the container. First and second belt tensioning assemblies are individually positioned in either a belt mechanism drive box or idler box.

20 Claims, 8 Drawing Sheets

FIG 5
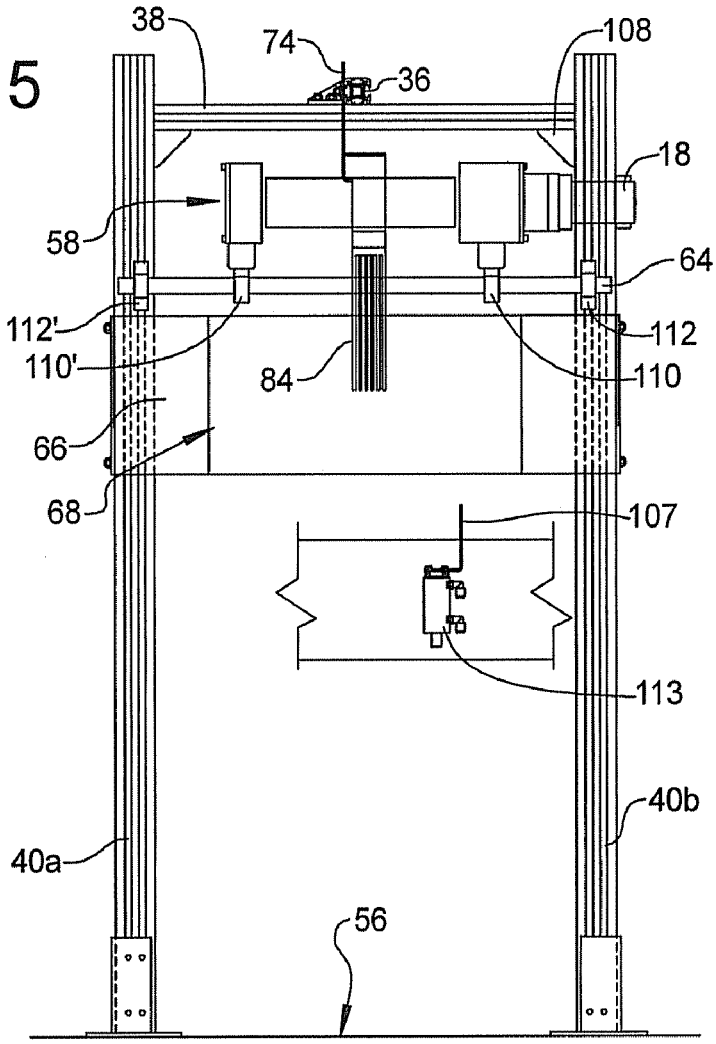
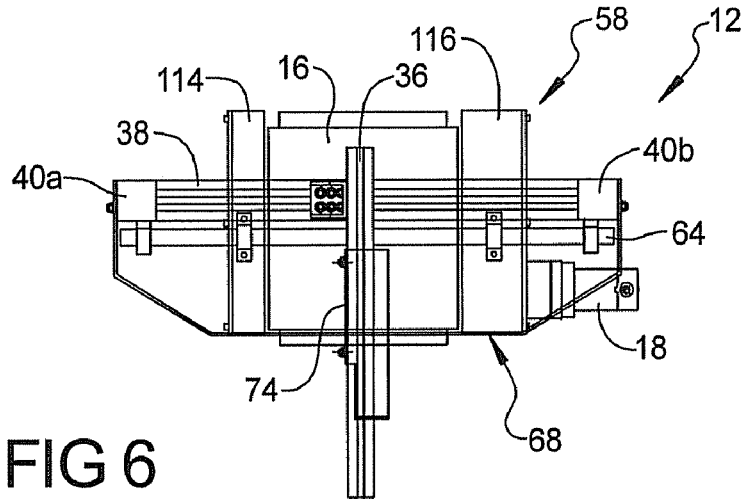
FIG 6

DOCUMENT PRINTER AND INSERTER

CROSS-REFERENCE TO RELATED APPLICATIONS

This application is a divisional of U.S. patent application Ser. No. 12/896,979 filed on Oct. 4, 2010. The entire disclosure of the above application is incorporated herein by reference.

FIELD

The present disclosure relates to document inserters used to insert documents in containers travelling on a conveyor system.

BACKGROUND

This section provides background information related to the present disclosure which is not necessarily prior art.

Document inserters are known that collect and collate one or more documents, orient the documents, open an envelope, and insert the collated documents into the envelope. A printer can be operated in conjunction with the document inserter. One such system is disclosed in U.S. Pat. No. 5,754,434 to Delfer et al. Document inserter systems are also known that include the capability to scan information from documents to be inserted. One such system is disclosed in U.S. Pat. No. 5,027,279 to Gottlieb et al. These systems include multiple, complex mechanical subsystems and occupy significant floor space.

SUMMARY

This section provides a general summary of the disclosure, and is not a comprehensive disclosure of its full scope or all of its features.

According to several embodiments, an inserter device for a document printer and inserter system includes a first container sensor. A belt mechanism includes a flexible delivery belt aligned to receive a printed document from a document printer. A motor operates to rotate the delivery belt in response to an actuation signal from the first container sensor indicating the presence of a container at a document loading position proximate to the delivery belt. A support shaft is rotatably connected to a support frame. The belt mechanism is fixedly connected to the support shaft. The support shaft rotates to achieve a desired belt drive angle and is releasably fixed to the support frame to maintain the belt drive angle. A rigid document diverter positioned proximate the delivery belt is oriented to deflect a document discharged from the delivery belt at the belt drive angle into the container.

According to other embodiments, an inserter device for a document printer and inserter system includes a support frame. A first container sensor is connected to the support frame. A belt mechanism connected to the support frame includes a flexible delivery belt having multiple belt segments, with successive ones of the belt segments connected by a belt pin. A drive sprocket connected to a drive shaft has multiple tooth pairs each having a first and a second tooth. A pin slot created between the first and the second tooth receives the belt pin to transfer rotational motion of the drive sprocket to rotational motion of the delivery belt. A motor operates to rotate the drive shaft in response to an actuation signal from the first container sensor indicating the presence of a container at a document loading position proximate to the delivery belt. A rigid document diverter positioned proximate the delivery belt acts to downwardly deflect a document transferred on the delivery belt into the container.

According to further embodiments, a document printer and inserter system includes a document printer, a conveyor for moving a container, and an inserter device receiving a document printed by the document printer. The inserter device includes a first container sensor; a belt mechanism including a flexible delivery belt aligned to receive a printed document from the document printer; and a motor rotating the delivery belt in response to an actuation signal from the first container sensor indicating the presence of a container at a document loading position of the conveyor proximate to the delivery belt. A support shaft is rotatably connected to a support frame. The belt mechanism is fixedly connected to the support shaft. The support shaft is rotated to achieve a desired belt drive angle and is releasably fixed to the support frame to maintain the belt drive angle for delivering the document transferred by the delivery belt to the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 5 is a front elevational view of the document inserter of FIG. 1;

FIG. 6 is a top plan view elevational view of the document inserter of FIG. 5;

Corresponding reference numerals indicate corresponding parts throughout the several views of the drawings.

DETAILED DESCRIPTION

Figure 1:
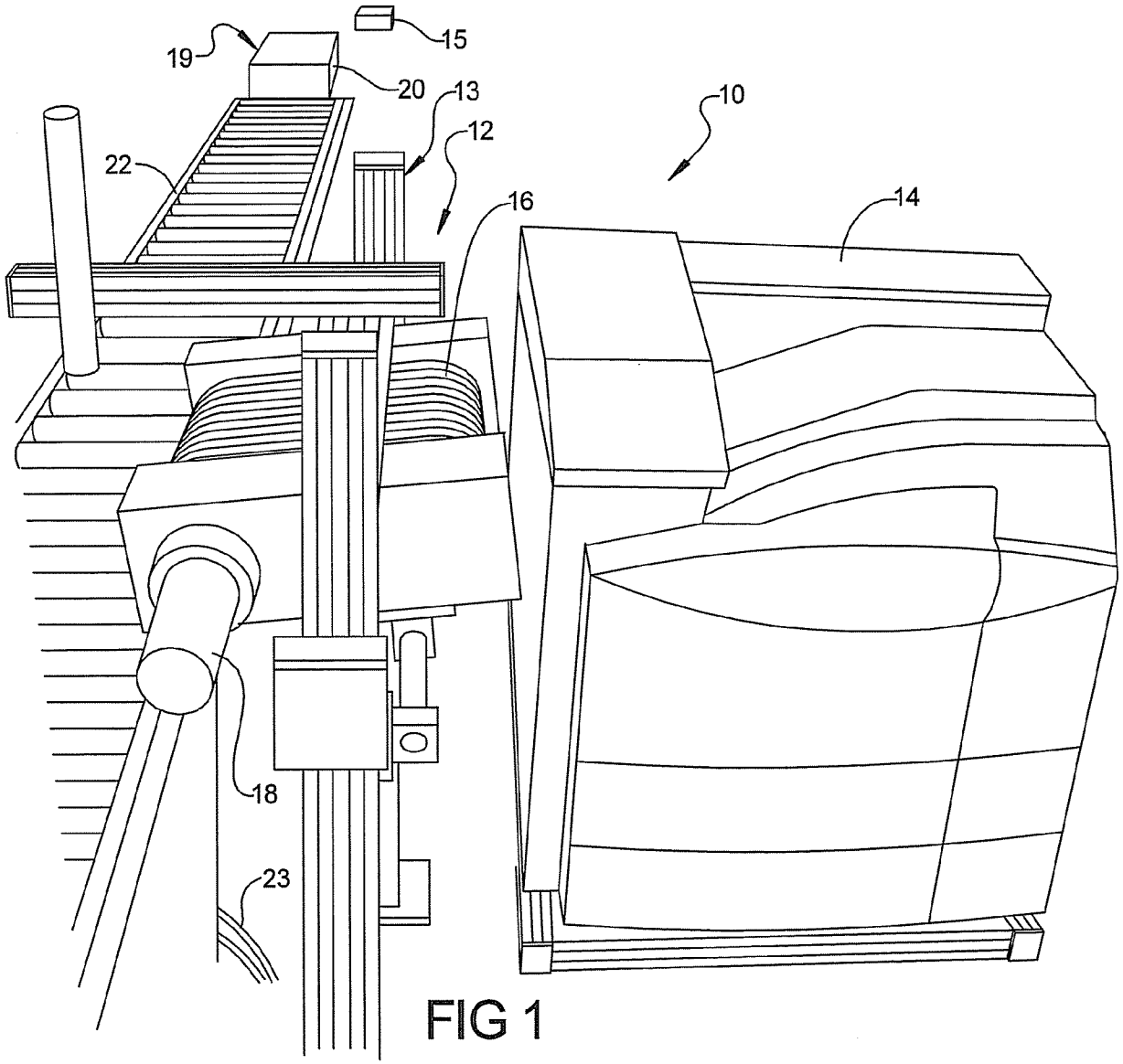
FIG. 1 is a left side elevational perspective view of a document printer and inserter of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a document printer and inserter system 10 includes an inserter device 12 positioned proximate to a document printer 14 such that individual documents 15 printed by printer 14 are received on a delivery belt 16, which is rotatably moved by a motor 18 to deliver documents 15 into an upper open side 19 of a plurality of containers 20. Containers 20 are transported by a conveyor 22. A power supply line 23 can be connected between conveyor 22 and inserter device 12 to provide electrical power for operation of motor 18. Document printer 14 can be any commercially available printer which can be programmed to produce multiple documents 15 in successive order, each having either the same or different data printed thereon.

Referring to FIG. 2 and again to FIG. 1, document printer 14 is supported by a support frame 24 such that a document discharge port 26 of document printer 14 is aligned for delivery of the documents 15 onto delivery belt 16. Inserter device 12 can further include first and second container sensors 28, 30. First and second container sensors 28, 30 can be proximity sensors, UPC code reading sensors such as laser sensors, or the like. First container sensor 28 is located proximate to a downstream end of delivery belt 16 with respect to conveyor 22 defining a document loading position 31. A container 20 sensed by first container sensor 28 which is therefore in document loading position 31 generates a first signal $S_1$ which initiates operation of motor 18 to deliver a document 15 from delivery belt 16 to the container 20, and further initiates operation of an air nozzle 32, which delivers a pressurized flow of air to redirect the document 15 exiting delivery belt 16 in a downward direction "Z" toward the conveyor 22. Air nozzle 32 can be supplied with pressurized air from an air cylinder 34 supplied with either electrical power to compress the air from a power connector 35 or with pressurized air from a remote power source (not shown) via power connector 35. Air cylinder 34 is connected to a cylinder support arm 36 which is connected to a connecting arm 38 extending away from printer 14. Connecting arm 38 is, in turn, connected between first and second support stanchions 40*a*, 40*b*, which provide vertical support for all of the members of inserter device 12. Connecting arm 38 is fastenably connected at opposite ends to support stanchions 40*a*, 40*b*. According to additional embodiments, air nozzle 32 can be replaced with a mechanical ejector which downwardly extends to push document 15 toward container 20.

Second container sensor 30 is located at the upstream end of delivery belt 16 with respect to conveyor 22. Second container sensor 30 can also be used for multiple functions. A second signal $S_2$ from second container sensor 30 can be used to initiate motion of a stop device which is shown and described in better detail in reference to FIG. 4 which stops container 20 proximate to delivery belt 16. Containers 20 transported on conveyor 22 in a container movement direction "A" therefore trigger operation of second container sensor 30 prior to triggering operation of first container sensor 28. According to several embodiments, the information read by second container sensor 30 can also be input into document printer 14 for confirmation that the information printed on the individual document 15 is the correct information for the particular container 20 positioned proximate to first and second container sensors 28, 30.

Once the document 15 is inserted into container 20, which can be determined for example by a delay time after initiation of motor 18, by a displacement sensor 41 which signals that delivery belt 16 has moved a specific distance, or by measuring a quantity of rotations of motor 18, container 20 is released from the document loading position 31. When first container sensor 28 no longer indicates the presence of container 20, loss of the first signal $S_1$ de-energizes motor 18.

Figure 3:
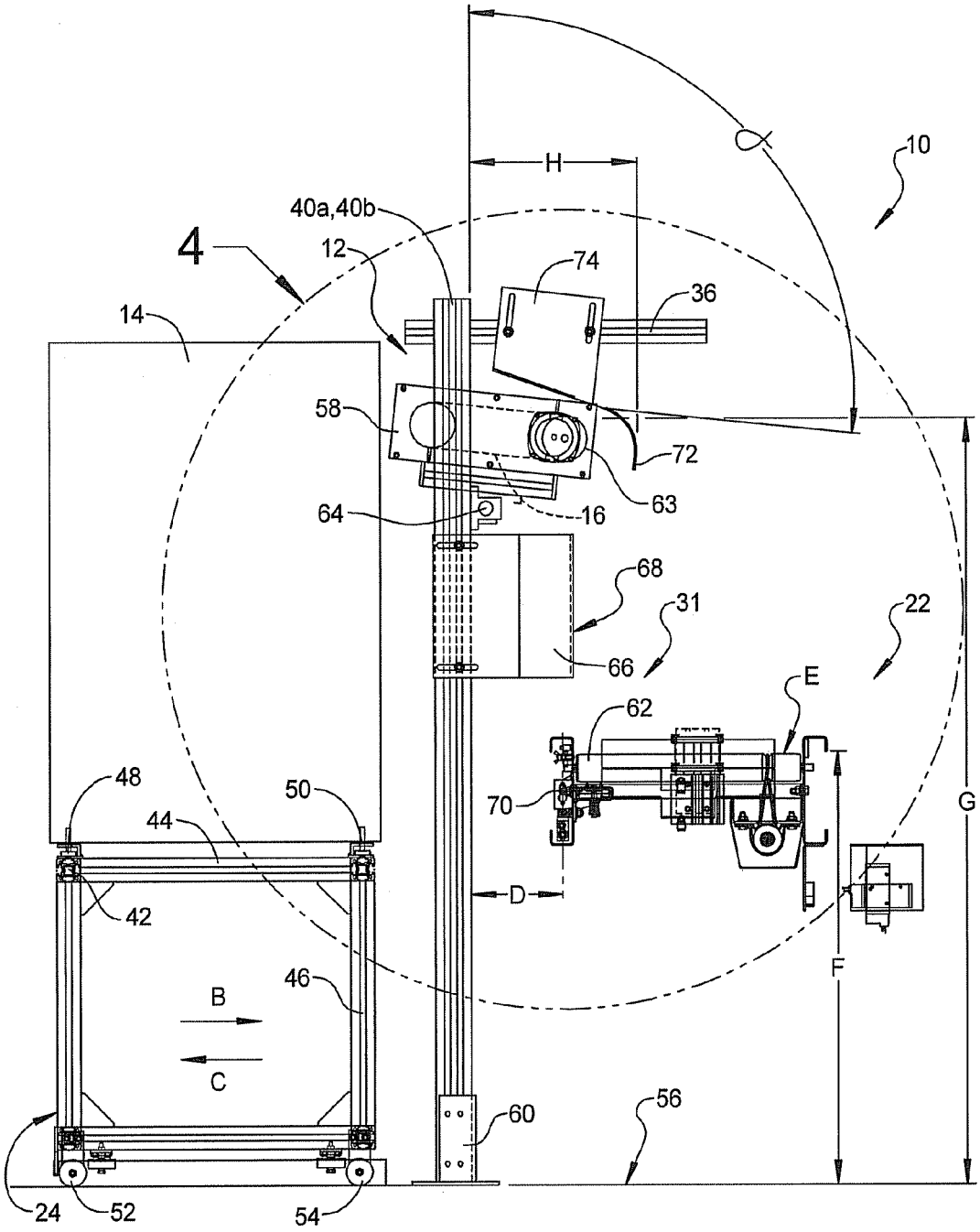
FIG. 3 is a left side elevational view of the document printer and inserter of FIG. 1.

Referring to FIG. 3, support frame 24, which is provided for support and positioning of the printer 14, can include a plurality of cross members 42, a plurality of brace members 44, and a plurality of support members 46. The cross members 42, brace members 44, and support members 46 together define a substantially rectangular shape for support frame 24.

This rectangular shape is not limiting, however. The geometry of the cross, brace, and support members 42, 44, 46, can also be varied to other geometric shapes depending on the geometry of printer 14. First and second connection members 48, 50, which can be, for example, be L-shaped or U-shaped steel members, are used to directly connect printer 14 to support frame 24, for example using fasteners (not shown). It is desirable to permit the movement of support frame 24 in either a printer alignment direction "B" or a printer removal direction "C". To provide for these motions, each of a first wheel set 52 and a second wheel set 54 are provided with support frame 24. First and second wheel sets 52, 54 provide for motion with respect to a planar surface 56, such as the floor of a manufacturing or warehouse facility. First and second wheel sets 52, 54 can also be releasably locked to retain a specific position of printer 14 with respect to a belt mechanism 58 of inserter device 12. This ensures that the documents exiting document printer 14 are positioned in alignment with delivery belt 16 (shown in phantom).

Each of the support stanchions, such as support stanchions 40*a*, 40*b*, can be fixed with respect to planar surface 56 using a plurality of brace members 60 fastenably connected to support stanchions 40*a*, 40*b* and to planar surface 56. Support stanchions 40*a*, 40*b* are therefore substantially fixed to define a conveyor spacing "D" with respect to conveyor 22. Conveyor 22 can include a rotating belt, or according to several embodiments, includes a plurality of conveyor rollers 62 which together define a roller support plane "E" upon which individual ones of the containers 20 are transported. The inserter device 12 can be releasably connected to conveyor 22, but according to several embodiments inserter device 12 is not directly connected to conveyor 22 to permit adjustment of conveyor spacing "D". This also permits adjustment of a support plane height "F" of the plurality of conveyor rollers 62 with respect to a belt discharge height "G" at a discharge end 63 of delivery belt 16. The belt discharge height "G" can be adjusted by raising or lowering belt mechanism 58, which contains delivery belt 16, by either raising or lowering a support shaft 64 from which belt mechanism 58 is supported. Support shaft 64 is connected to both of the support stanchions 40*a*, 40*b*.

Conveyor spacing "D" is defined from an end of the conveyor rollers 62 positioned closest to support stanchions 40*a*, 40*b*. The position and orientation of a first guide member 66, connected to at least one of the support stanchions 40*a*, 40*b*, can be adjusted such that a guide face 68 of first guide member 66 is positioned coplanar with a stanchion facing end 70 of the conveyor rollers 62. Guide face 68 therefore defines an alignment and contact face for the containers 20 as they move on conveyor 22 into document loading position 31. Conveyor spacing "D" is therefore determined at the stanchion facing end 70 of conveyor rollers 62.

In order to assist with the delivery of documents 15, belt mechanism 58, and therefore delivery belt 16, can be angled with respect to support stanchions 40*a*, 40*b*, defining an angle $\alpha$. According to several embodiments, angle $\alpha$ is approximately 96 degrees; however, angle $\alpha$ can be varied at the discretion of the installer, depending on several factors, including the quantity of individual sheets of the documents to be inserted, the operating speed of the conveyor, the quantity of containers moving on the conveyor per unit time, and, therefore, the necessary operating speed of delivery belt 16. To further assist in directing the individual documents 15 into the various containers 20, a curved document diverter 72 is positioned outboard of delivery belt 16 at a diverter positioning dimension "H", which is selected to maximize the number of different container sizes that can be fed using inserter device 12. Document diverter 72 is connected to a second guide member 74, which is releasably connected to cylinder support arm 36.

Figure 4:
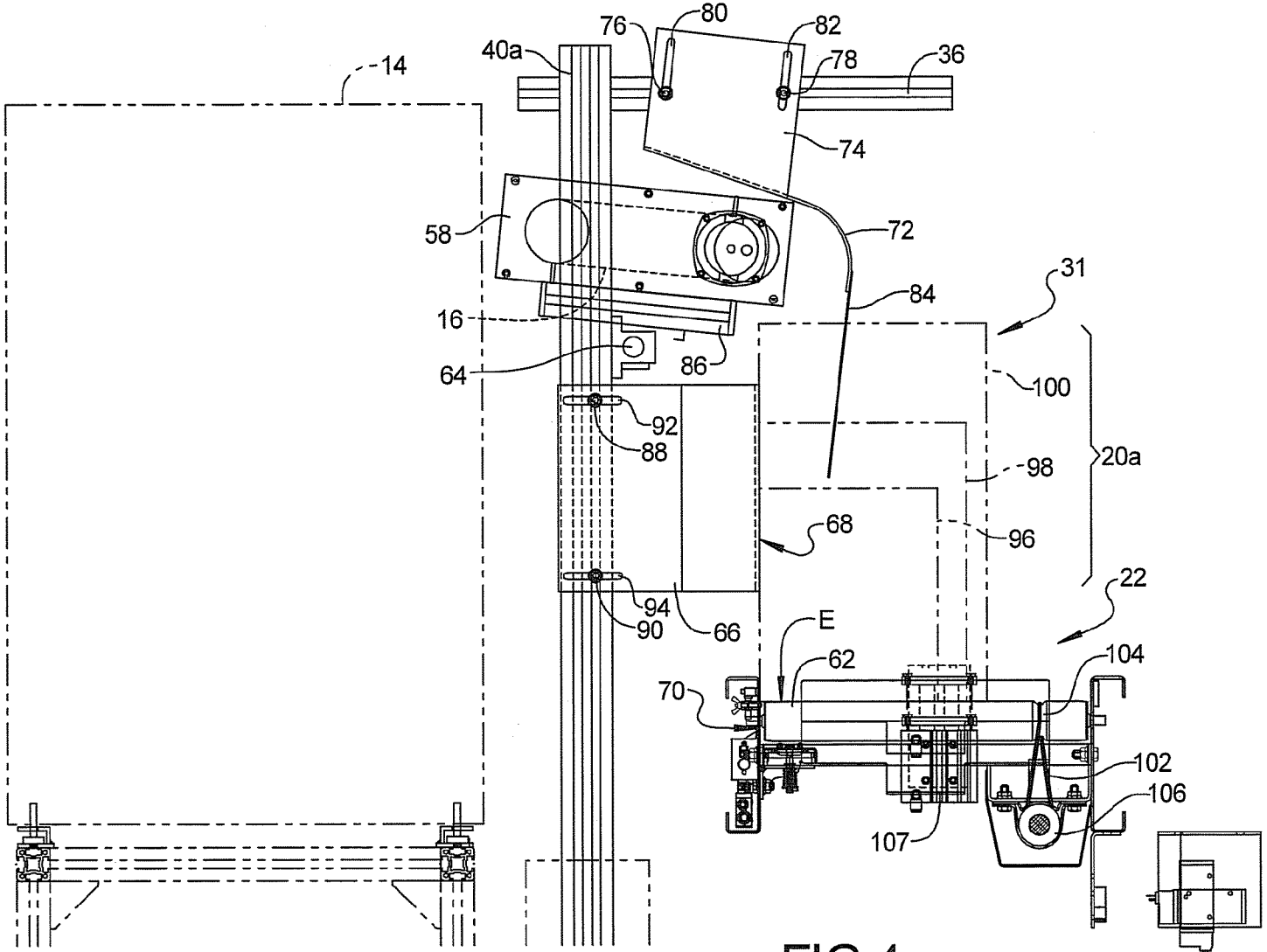
FIG. 4 is a left side elevational view of area 4 of FIG. 3.

Referring to FIG. 4 and again to FIG. 3, second guide member 74 is releasably connected to cylinder support arm 36 using first and second fasteners 76, 78, which are individually inserted through first and second elongated slots 80, 82 created in second guide member 74. The positioning of first and second fasteners 76, 78 in the first and second elongated slots 80, 82 can vary to change the orientation of document diverter 72, as well as to change the outward extending position defined by diverter positioning dimension "H". Because document diverter 72 is substantially rigid, in order to provide for the maximum flexibility to insert documents in multiple size containers, an elastically flexible diverter 84, made for example of a polymeric or a rubber material, is connected to a free end of document diverter 72 and extends substantially downwardly toward conveyor 22. Belt mechanism 58, which provides delivery belt 16, is further supported using a mechanism support beam 86. First guide member 66 is releasably connected to one or both of support stanchions 40*a*, 40*b* using third and fourth fasteners 88, 90, each inserted through one of a third or fourth elongated slot 92, 94 created in first guide member 66. Third and fourth elongated slots 92, 94 are oriented generally perpendicular with respect to a longitudinal axis of support stanchions 40*a*, 40*b* to allow the position of guide face 68 to be adjusted with respect to conveyor spacing "D". Guide face 68 is positioned to slidably interact with a side wall of multiple size containers 20. Multiple individual space envelopes for containers 20 are depicted, for example, as first, second, and third container space envelopes 96, 98, 100. These examples are not limiting. Flexible diverter 84 is flexible both toward and away from support stanchions 40*a*, 40*b*, as well as toward and away from the viewer, as shown in FIG. 4, to permit passage of the various containers shown by first, second, and third container space envelopes 96, 98, 100 while simultaneously providing for direct alignment of the documents exiting at discharge end 63 of delivery belt 16 and redirected by document diverter 72 into the open upper side of the specific container.

The individual conveyor rollers 62 are axially rotated using a drive belt 102, such as a flexible polymeric material or a rubber material, which is received in a belt receiving slot 104 of each conveyor roller 62 and frictionally rotated with respect to a driveshaft 106 extending for a length of conveyor 22. Axial rotation of driveshaft 106 therefore co-rotates each of the conveyor rollers 62 at a common rotational speed. The conveyor rollers 62 continue to axially rotate when one of the containers 20 is temporarily stopped at document loading position 31.

Figure 2:
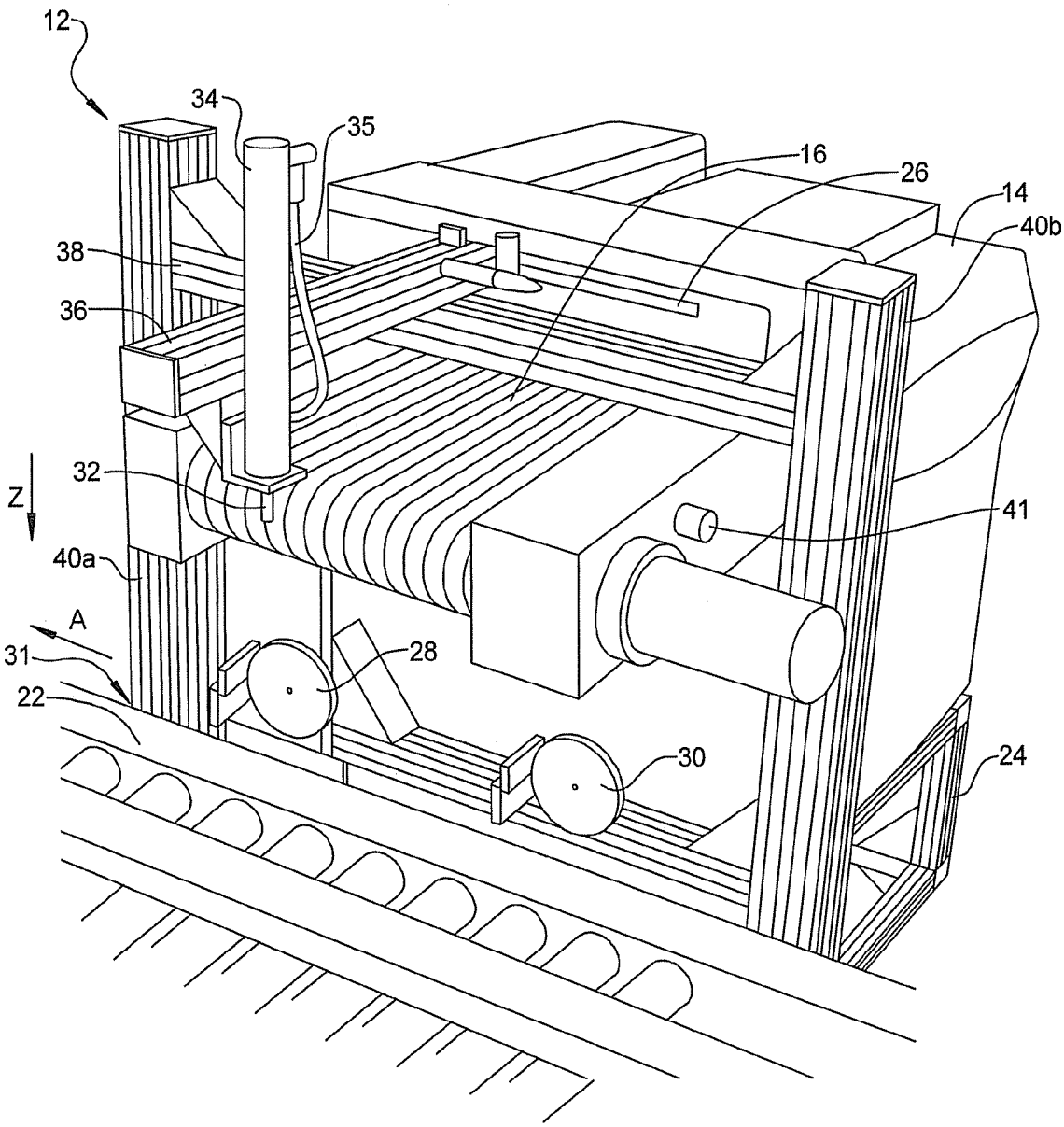
FIG. 2 is a left front perspective view of the document printer and inserter of FIG. 1.

With continuing reference to FIG. 4 and referring again to FIG. 2, one or more stop devices 107 can be positioned between individual ones of the conveyor rollers 62 at the document loading position of conveyor 22, which coincides with the position of delivery belt 16. As containers 20 are being transported by conveyor 22, stop device 107 will normally be positioned in a lowered condition, shown in FIG. 4, until a container 20*a* is sensed by second container sensor 30. At this time, stop device 107 is actuated raising stop device 107 to the position shown in phantom in FIG. 4, which is raised above roller support plane "E". The raised position of stop device 107 temporarily stops travel of container 20*a* at the document loading position 31. Stop device 107 is maintained in the raised position until an insertion complete signal from inserter device 12 is received, indicating that the document has been inserted into container 20*a*. At this time, stop device 107 is lowered to the position shown below roller support plane "E" to allow continued passage of container 20*a* for discharge from conveyor 22. Stop device 107 therefore provides a positive stop to ensure that individual containers such as container 20*a* receive a designated document before the container 20*a* proceeds along conveyor 22.

Referring to FIG. 5, support stanchions 40*a*, 40*b* can be further reinforced using corner braces 108 at the junction of the support stanchions 40*a*, 40*b* with connecting arm 38. In addition, first support clamps 110, 110' can be used to directly connect, and thereby support, members of belt mechanism 58 directly to support shaft 64. Support shaft 64 is connected individually to support stanchions 40*a*, 40*b* using second support clamps 112, 112'. An actuator 113, such as a pneumatic actuator, is connected to structure of the conveyor 22 and used to raise or lower stop device 107, as previously described.

Referring to FIG. 6, belt mechanism 58 further includes an idler box 114 and a drive box 116. Idler box 114 and drive box 116 located on opposite sides of delivery belt 16. Motor 18 is connected to drive box 116 and is spaced from guide face 68.

Figure 7:
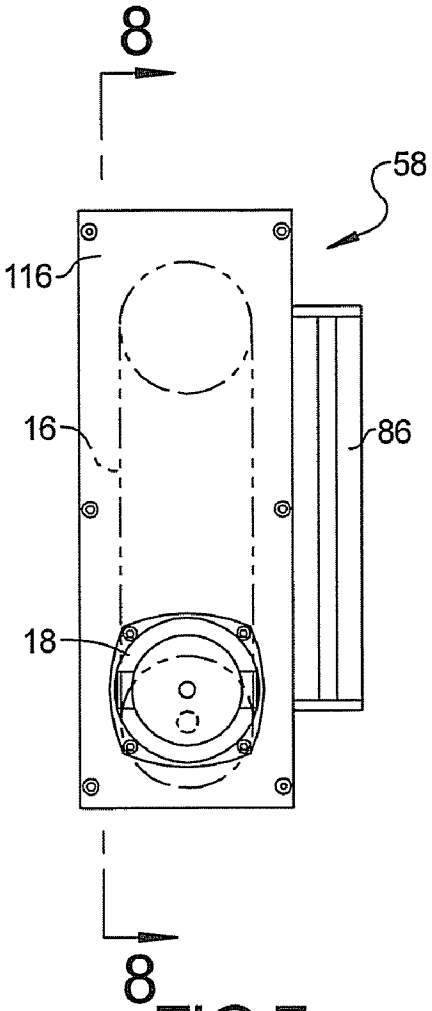
FIG. 7 is an end elevational view of a belt mechanism for the document inserter of FIG. 5.

Referring to FIG. 7, belt mechanism 58 fastenably supports motor 18 and includes mechanism support beam 86 fastenably connected thereto.

Figure 8:
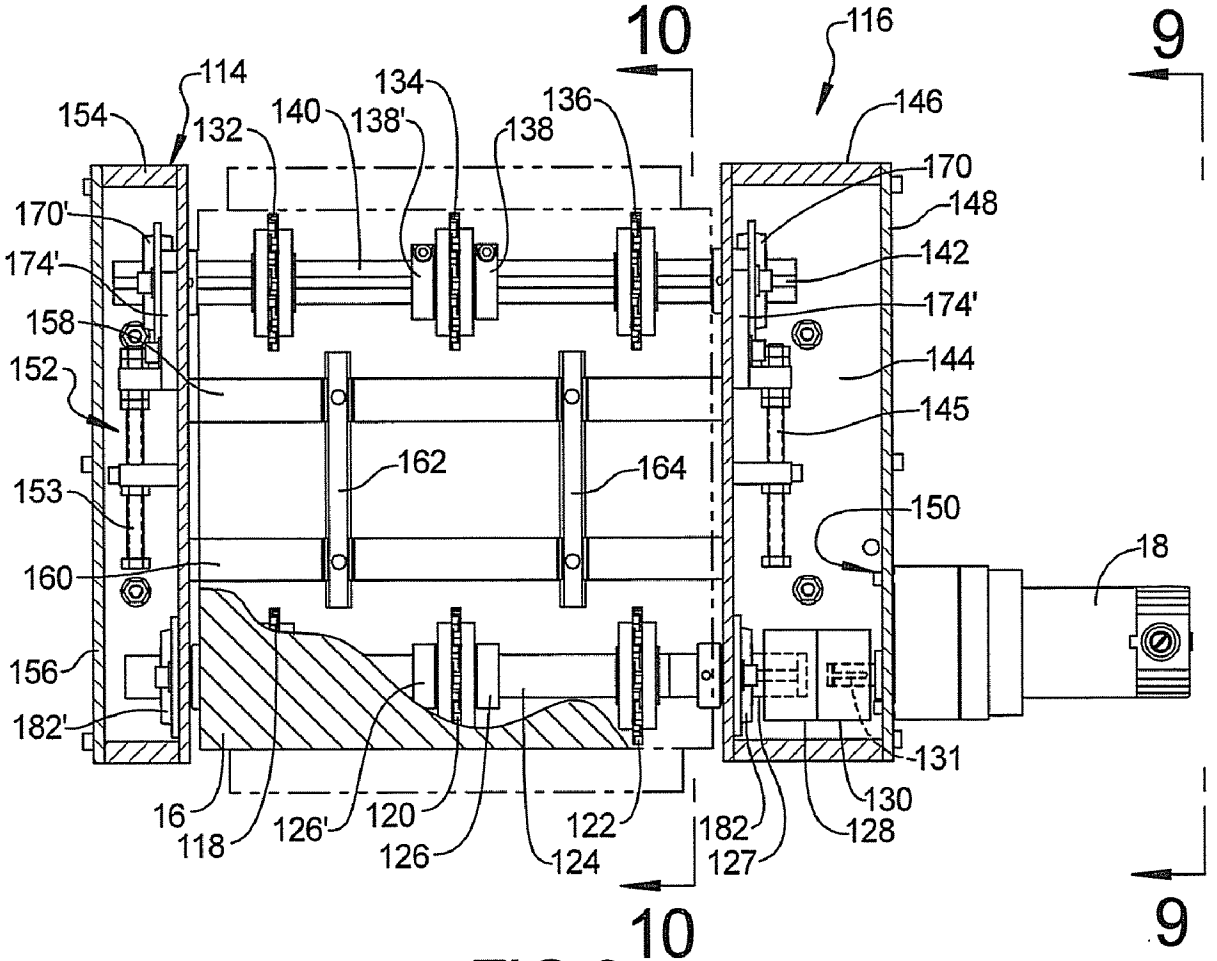
FIG. 8 is a partial cross sectional top plan view taken at section 8 of FIG. 7.

Referring to FIG. 8, delivery belt 16 is engaged by and rotated using each of first, second, and third drive sprockets 118, 120, 122, which are each connected to a driveshaft 124. According to several embodiments, driveshaft 124 is square shaped and is rotatably supported at opposite ends by the idler box 114 and drive box 116. Retainer rings 126, 126' are positioned on opposite sides of second drive sprocket 120 to fix a position of second drive sprocket 120 substantially centered between idler box 114 and drive box 116. A free end 127 of driveshaft 124 extends into drive box 116. A keyed split coupler half 128 is connected to free end 127. A split coupler half with spider 130 is coupled to keyed split coupler half 128 within drive box 116. Split coupler half with spider 130 is coupled to a driveshaft 131 extending into drive box 116 which is rotatably driven by motor 18.

Belt mechanism 58 further includes first, second, and third keyed sprockets 132, 134, 136, which are individually aligned with first, second, and third drive sprockets 118, 120, 122. Each of the first, second, and third keyed sprockets 132, 134, 136 rotate in response to the powered driving force applied to delivery belt 16 by first, second, and third drive sprockets 118, 120, 122. Shaft collars 138, 138', positioned on opposite sides of second keyed sprocket 134, are used to fix a position of second keyed sprocket 134 on a running shaft 140 such that second keyed sprocket 134 is aligned with second drive sprocket 120. Each of the first, second, and third keyed sprockets 132, 134, 136 are keyed to a key slot 142 created in running shaft 140.

Belt mechanism 58 is provided with both first and second tensioning assemblies that allow a spacing between running shaft 140 and driveshaft 124 to be adjusted to thereby adjust a tension of delivery belt 16. A first tensioning assembly 144 is provided in drive box 116 having a first tensioning rod 145 which is threaded such that axial displacement of first tensioning rod 145 by rotation generates a force acting on running shaft 140. First tensioning rod 145 and first tensioning assembly 144 are supported on drive box frame 146 of drive box 116. A drive box cover 148 supports motor 18 by extension of a plurality of motor mount fasteners 150 through drive box cover 148 to fastenably engage with motor 18. A second tensioning assembly 152 is provided in idler box 114. Second tensioning assembly 152 is a mirror image of first tensioning assembly 144. Second tensioning assembly 152 includes a second tensioning rod 153 which is threaded similar to first tensioning rod 145 such that axial displacement of second tensioning rod 153 by rotation also produces a force on running shaft 140. The components of second tensioning assembly 152 are supported by an idler box frame 154 of idler box 114 and enclosed using an idler box cover 156.

The idler box 114 and drive box 116 are spatially separated using first and second frame weldments 158, 160 which are individually welded at free ends to the idler box 114 or the drive box 116, respectively. First and second guide rails 162, 164 are individually connected to both first and second frame weldments 158, 160. First and second guide rails 162, 164 are provided to support delivery belt 16 between the drive sprockets and keyed sprockets.

Figure 9:
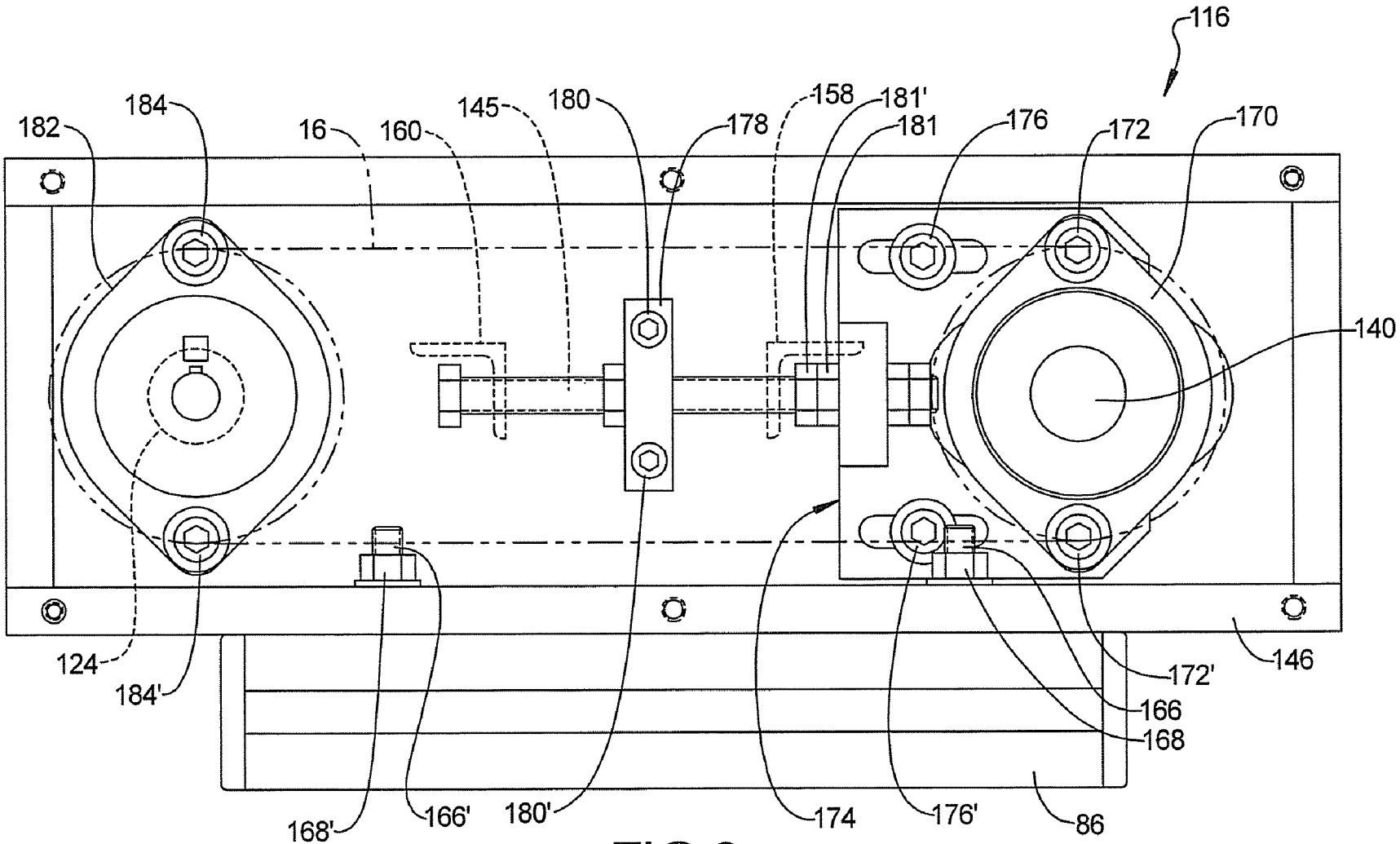
FIG. 9 is a side elevational view taken at section 9 of FIG. 8.

Referring to FIG. 9, individual components in drive box 116 are shown in better detail by removal of motor 18 and drive box cover 148. Mechanism support beam 86 is releasably connected to drive box frame 146 using a plurality of bolts 166 and nuts 168. Running shaft 140 is rotatably disposed in a first bearing flange 170, which is fastenably connected using fasteners 172, 172' to a bearing slide plate 174. Fasteners 176, 176' releasably join bearing slide plate 174 to drive box frame 146. Bearing slide plate 174 is slidably disposed within drive box 116 by loosening fasteners 176, 176'. Bearing slide plate 174 can then be displaced as fasteners 176, 176' are guided within elongated slots created in bearing slide plate 174. This permits axial displacement of first tensioning rod 145 to displace bearing slide plate 174 and, thereby, to displace first bearing flange 170 and running shaft 140 with respect to a position of driveshaft 124. First tensioning rod 145 is threadably received in an adjustment nut 178 which is fastenably connected to drive box frame 146 using fasteners 180, 180'. A double nut arrangement 181, 181' on first tensioning rod 145 which contacts bearing slide plate 174 prevents further rotation of first tensioning rod 145 and thereby locks the tensioned position of running shaft 140 and delivery belt 16. Driveshaft 124 is rotatably supported in drive box 116 using a second bearing flange 182 which is fastened to drive box frame 146 using fasteners 184, 184'. Driveshaft 124 is axially rotatable in second bearing flange 182; however, second bearing flange 182 substantially fixes a side-to-side position of driveshaft 124 in drive box 116.

Figure 10:
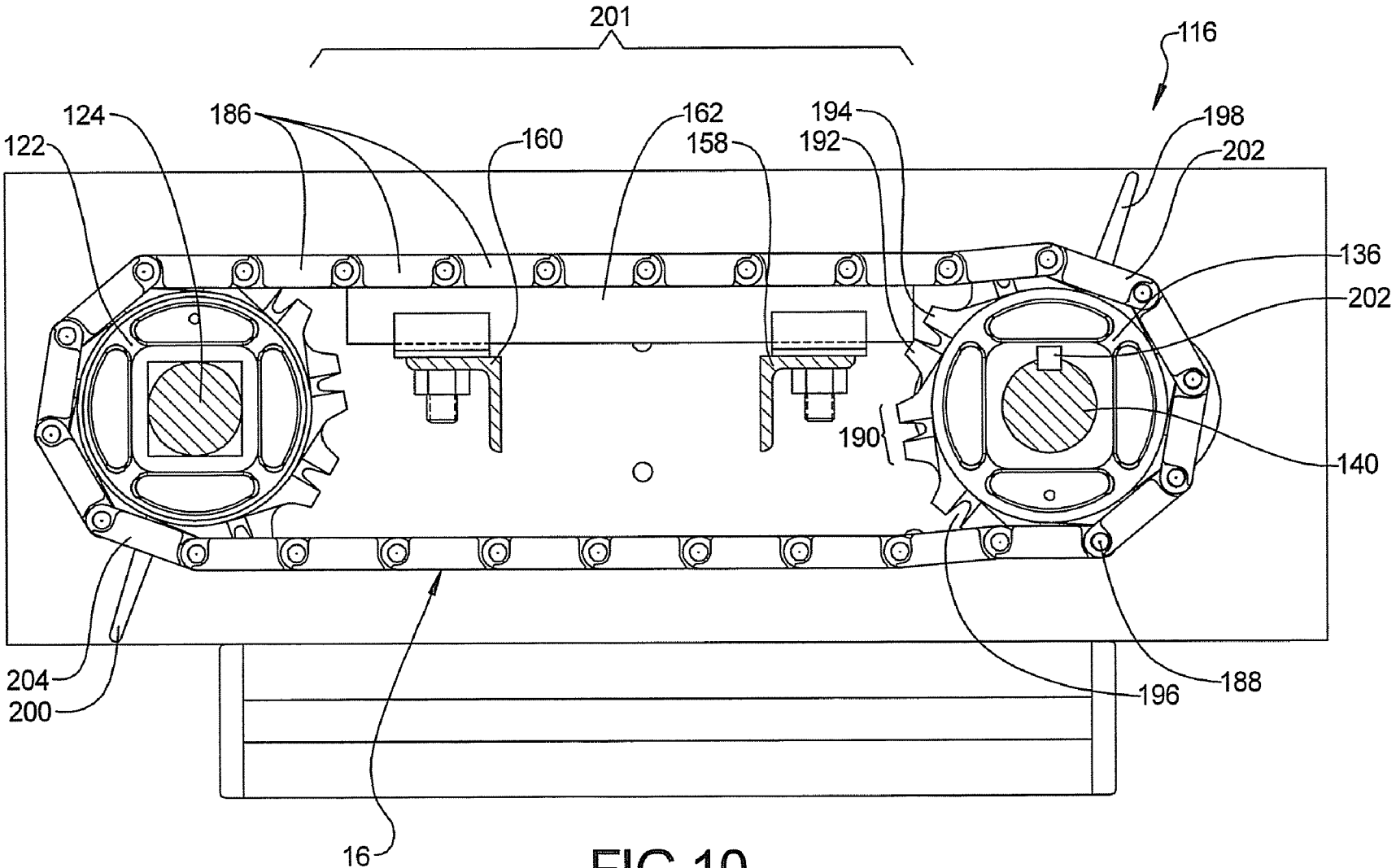
FIG. 10 is a cross sectional side elevational view taken at section 10 of FIG. 8.

Referring to FIG. 10, delivery belt 16 includes a plurality of belt segments 186, which are joined using belt pins 188 between successive ones of the belt segments 186. Belt pins 188 allow delivery belt 16 to conform to the diameters of the first, second, and third drive sprockets 118, 120, 122 and the first, second, and third keyed sprockets 132, 134, 136. A plurality of tooth pairs 190 are created on each of the drive sprockets 118, 120, 122 and keyed sprockets 132, 134, 136. Each tooth pair 190 includes a first tooth 192 and a second tooth 194, defining a pin slot 196 therebetween. Pin slot 196 is sized to slidably receive belt pins 188. First and second pusher members 198, 200 are integrally provided with individual belt segments 202, 204, respectively. First and second pusher members 198, 200 extend outwardly with respect to delivery belt 16 and are positioned at opposite locations on delivery belt 16 such that a document received on delivery belt 16 will be contacted by either first or second pusher member 198, 200 to discharge the document from delivery belt 16. First guide rail 162 is also clearly visible in FIG. 10 performing the support function of supporting delivery belt 16 in its free span between the drive sprockets and keyed sprockets, respectively. First and second guide rails 162, 164 are planar to create a planar segment 201 of delivery belt 16 to evenly support the document helping to prevent the document from lifting off delivery belt 16 during delivery. First and second guide rails 162, 164 (second guide rail 164 is not clearly visible in this view) are made from a material which is conducive to minimizing sliding friction with delivery belt 16 while providing support for delivery belt 16. A polymeric material such as a polyamid or similar low friction material is suitable for this use.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A document printer and inserter system, comprising:
- a document printer;
- a conveyor for moving a container; and
- an inserter device receiving a document printed by the document printer, the inserter device including:
  - a first container sensor;
  - a belt mechanism, the belt mechanism including:
    - a flexible delivery belt aligned to receive a printed document from the document printer; and
    - a motor rotating the delivery belt in response to an actuation signal from the first container sensor indicating the presence of a container at a document loading position of the conveyor proximate to the delivery belt; and
  - a support shaft rotatably connected to a support frame, the belt mechanism connected to the support shaft, the support shaft rotated to achieve a desired belt drive angle and releasably fixed to the support frame to maintain the belt drive angle for delivering the document transferred by the delivery belt to the container.

2. The document printer and inserter system of claim 1, wherein the belt mechanism further includes:
- a plurality of drive sprockets connected to a drive shaft, the drive shaft rotated by the motor; and
- a plurality of keyed sprockets connected to a running shaft;
- wherein the drive sprockets and the keyed sprockets engage the delivery belt.

3. The document printer and inserter system of claim 2, further including a planar guide rail positioned between the drive sprockets and keyed sprockets creating a planar segment of the delivery belt for support of the document.

4. The document printer and inserter system of claim 1, further including a rigid document diverter connected to the support frame and positioned proximate the document loading position to deflect the document discharged from the delivery belt at the belt drive angle into the container.

5. The document printer and inserter system of claim 4, further including a flexible diverter connected to the rigid document diverter able to deflect from contact with the container approaching the document loading position.

6. The document printer and inserter system of claim 1, further including first and second support stanchions supporting the conveyor and the inserter device.

7. The document printer and inserter system of claim 6, further including a flexible diverter connected to the support frame and positioned proximate the document loading position, the flexible diverter flexible both toward and away from the support stanchions and parallel to the conveyor to permit passage of the container while simultaneously providing for direct alignment of the document exiting a discharge end of the delivery belt and redirected by the flexible document diverter into an open upper side of the container.

8. The document printer and inserter system of claim 1, further including a second container sensor generating a second signal when the container approaches the document loading position.

9. A document printer and inserter system, comprising:
- a document printer;
- a conveyor for moving a container; and
- an inserter device receiving a document printed by the document printer, the inserter device including:
  - a first container sensor;
  - a belt mechanism, the belt mechanism including:
    - a flexible delivery belt aligned to receive a printed document from the document printer; and
    - a motor rotating the delivery belt in response to an actuation signal from the first container sensor indicating the presence of a container at a document loading position of the conveyor proximate to the delivery belt for delivering the document transferred by the delivery belt to the container;
- a document loading position defined when the container is sensed by first container sensor, the first container sensor in the document loading position generating a first signal which initiates operation of the document printer and the motor to deliver the document from the printer via the delivery belt to the container.

10. The document printer and inserter system of claim 9, further including a support shaft rotatably connected to a support frame, the belt mechanism connected to the support shaft, the support shaft rotated to achieve a desired belt drive angle and releasably fixed to the support frame to maintain the belt drive angle for delivering the document.

11. The document printer and inserter system of claim 10, further including an air nozzle connected to a support arm extending from the support frame, wherein the first sensor in the document loading position further initiates operation of the air nozzle acting to deliver a pressurized flow of air to redirect the document exiting the delivery belt in a downward direction toward the conveyor.

12. The document printer and inserter system of claim 9, further including a second sensor positioned at an upstream end of the delivery belt with respect to the conveyor, wherein a signal from the second sensor is input into the document printer confirming that information printed on the document is correct for the container positioned proximate to the first and second container sensors at the document loading position.

13. The document printer and inserter system of claim 9, wherein confirmation that the document is inserted into the container is determined by a delay time after initiating operation of the motor.

14. The document printer and inserter system of claim 9, wherein confirmation that the document is inserted into the container is determined by a displacement sensor which signals the delivery belt has moved a specific distance.

15. The document printer and inserter system of claim 9, wherein confirmation that the document is inserted into the container is determined by a measured quantity of rotations of the motor after receiving the actuation signal.

16. The document printer and inserter system of claim 9, wherein following confirmation of the document being inserted into container, a loss of the first signal from the first container sensor acts to de-energize the motor, and release the container from the document loading position.

17. A document printer and inserter system, comprising:
- a document printer;

a conveyor for moving a container; and an inserter device receiving a document printed by the document printer, the inserter device including:

a first container sensor;

a belt mechanism, the belt mechanism including:

a flexible delivery belt aligned to receive a printed document from the document printer; and a motor rotating the delivery belt in response to a first signal from the first container sensor indicating the presence of a container at a document loading position of the conveyor for delivering the document transferred by the delivery belt to the container; and a stop device provided with the conveyor at the document loading position and normally positioned in a lowered condition;

the document loading position defined when the container is sensed by the first container sensor positioned proximate to the delivery belt, the first container sensor in the document loading position generating the first signal which further initiates operation of the document printer and the stop device.

18. The document printer and inserter system of claim 17, wherein the stop device is repositioned to a raised position to temporarily stop travel of the container on the conveyor when the container is sensed by a second container sensor.

19. The document printer and inserter system of claim 18, wherein the stop device is maintained in the raised position until an insertion complete signal is received from the inserter device indicating the document has been inserted into the container.

20. The document printer and inserter system of claim 18, wherein the second container sensor is located at an upstream end of the delivery belt with respect to the conveyor, the second container sensor creating a second signal used to initiate motion of the stop device.

* * * * *